US005628638A

United States Patent [19]

Tojo et al.

[11] Patent Number: 5,628,638

[45] Date of Patent: May 13, 1997

[54] ELECTRIC CONNECTOR

[75] Inventors: Katsutoshi Tojo; Shigetoshi Yamaguchi, both of Machida; Michio Shimizu, Sagamihara, all of Japan

[73] Assignee: Molex Incorporated, Lisle, Ill.

[21] Appl. No.: 570,176

[22] Filed: Dec. 7, 1995

[30] Foreign Application Priority Data

Jan. 20, 1995 [JP] Japan ..... 7-026309

[51] Int. Cl.[6] ..... H01R 13/40

[52] U.S. Cl. ..... 439/78; 439/590

[58] Field of Search ..... 439/78, 246, 590, 439/937

[56] References Cited

U.S. PATENT DOCUMENTS

| | | | |
|---|---|---|---|
| 4,056,300 | 11/1977 | Schumacher | 339/103 R |
| 4,722,691 | 2/1988 | Gladd et al. | 439/79 |
| 5,350,307 | 9/1994 | Takagishi et al. | 439/79 |
| 5,370,540 | 12/1994 | Kobayashi | 439/78 |
| 5,380,222 | 1/1995 | Kobayashi | 439/590 |

FOREIGN PATENT DOCUMENTS

| | | |
|---|---|---|
| 2-14777 | 4/1990 | Japan . |
| 3-2564 | 1/1991 | Japan . |

*Primary Examiner*—Gary F. Paumen

*Attorney, Agent, or Firm*—Stephen Z. Weiss

[57] ABSTRACT

Disclosed is an improved electric connector having pin-terminals press-fit in an "L"-shaped housing. The vertical wall of the housing comprises a first longitudinal support beam and a lateral arrangement of first flexible joints, which are separated by first slits and integrally connected to the first longitudinal support beam. The horizontal floor of the housing comprises a second longitudinal support beam, a lateral arrangement of second flexible joints, which are separated by second slits, and are integrally connected to the second longitudinal support beam and a lateral arrangement of terminal holding sleeves, each sleeve having a terminal receiving aperture. The terminal holding sleeves are integrally connected both to the first joints of the vertical wall and the second joints of the horizontal floor, thus lying therebetween. The "L" shaped housing structure gives the electric connector good mechanical strength while allowing the terminal holding sleeves to the displaced laterally, thereby absorbing any stresses appearing between the pin-terminals and selected conductors of the printed circuit, which stresses otherwise would cause the peeling-off or cracking in soldered portions.

6 Claims, 10 Drawing Sheets

ELECTRIC CONNECTOR

FIELD OF THE INVENTION

The present invention relates to an electric connector for making electric connections between a headers to be fixed to printed circuit board or connecting selected conductors of the printed circuits to associated wires.

DESCRIPTION OF RELATED ART

A variety of electric connectors are used in making electric connections between electric devices. These electric connectors are designed based upon a particular purpose and place of use. One such group of electric connectors is used to connect selected conductors of printed circuit boards to associated wires.

Such an electric connector is called a header and has a plurality of pin terminals press fit into its housing. One end of each pin terminal is soldered to a selected conductor on the printed circuit board. During the soldering procedure between the pin terminal and the selected conductor, stresses may occur which are caused by the difference in thermal expansion between the printed circuit board and the header housing. As a result of the stress, the soldered areas sometimes peel off from the terminal pin or crack resulting in incomplete or degraded electrical connections.

In an attempt to solve this problem, Japanese Utility Model Application Laid-Open No. 2-14777 teaches the use of flexible joints being formed between the terminal holding sleeves and the connector housing. These flexible joints absorb stresses occurring between pin terminals and selected conductors of printed circuit board to prevent the peeling-off or cracking in soldered areas. In another attempt to solve the problem, Japanese Utility Model Application Laid-Open No. 3-2564 teaches the use of pin terminals in the connector housing being separated by slits to absorb the stresses.

These solutions to the problem, however, cause some adverse effects. One such adverse effect is the inflexibility in the spacing between the terminals if adequate mechanical strength is provided. Another adverse effect is that if adequate flexibility in spacing between the terminals is provided there is low mechanical strength reducing the stability needed for locating the pins in holes in the printed circuit board prior to soldering. Therefore, there is an increased demand for headers which absorb stress due to differing thermal expansion reducing the stress which could cause a solder joint to peel off or crack while assuring the stability with which the header holds the pin terminals so that terminals in the header can be easily located in holes in the printed circuit board.

SUMMARY OF THE INVENTION

In view of the above, one object of the present invention is to provide a header which can absorb stresses caused by different thermal expansion between a printed circuit board and a connector housing, where the absorption of these stresses during the soldering of pin terminals to a printed circuit board will reduce the tendency of the soldered portion from peeling off or cracking, while still assuring the stability of the pin terminals in the header during mounting of the terminals in holes in the printed circuit board.

To attain this and other objects a header is provided having a plurality of terminal pins adapted to be soldered to a planar printed circuit board. The plurality of terminal pins is held by the header in a parallel side by side array. A housing is made of a dielectric material. The housing includes a holding sleeve for each terminal pin, first and second generally rigid longitudinal support beams parallel to each other with one support beam located on opposite sides of the side by side pin array and two flexible joints extending from each holding sleeve to a respective support beam. The flexible joints are adapted to allow movement of the holding sleeves in a plane parallel to the plane of the printed circuit board so that the pins can move independently toward and away from each other.

In a second embodiment, the second support beam of the header is located in close proximity to the printed circuit board and the first support beam is located a short distance from the printed circuit board. The first support beam is adapted to engage with and lock onto a locking member on a connector mateable with the terminal pins.

In a third embodiment, a third generally rigid longitudinal support beam is provided. This third longitudinal support beam, parallel to the first longitudinal support beam, is located in close proximity to the surface of the printed circuit board and on the side of the pin array that the first longitudinal support beam is located. At least two flexible joints extend from and connect the first and third longitudinal support beams. Each of the flexible joints is located between adjacent flexible joints extending between the first longitudinal support beam and the holding sleeves.

This arrangement has the effect of increasing the mechanical strength of the header, increasing the resistance against the twisting of the electric connector while providing the flexibility needed to allow independent movement of the pins in a plane parallel to the surface of the printed circuit board while the pins remain generally perpendicular to the board.

BRIEF DESCRIPTION OF THE DRAWINGS

Other objects and advantages of the present invention will be understood from the following description of the header according to the preferred embodiment of the present invention, which embodiment is shown in the accompanying drawings, in which.

DETAILED DESCRIPTION OF THE PREFERRED EMBODIMENT

Figure 1:
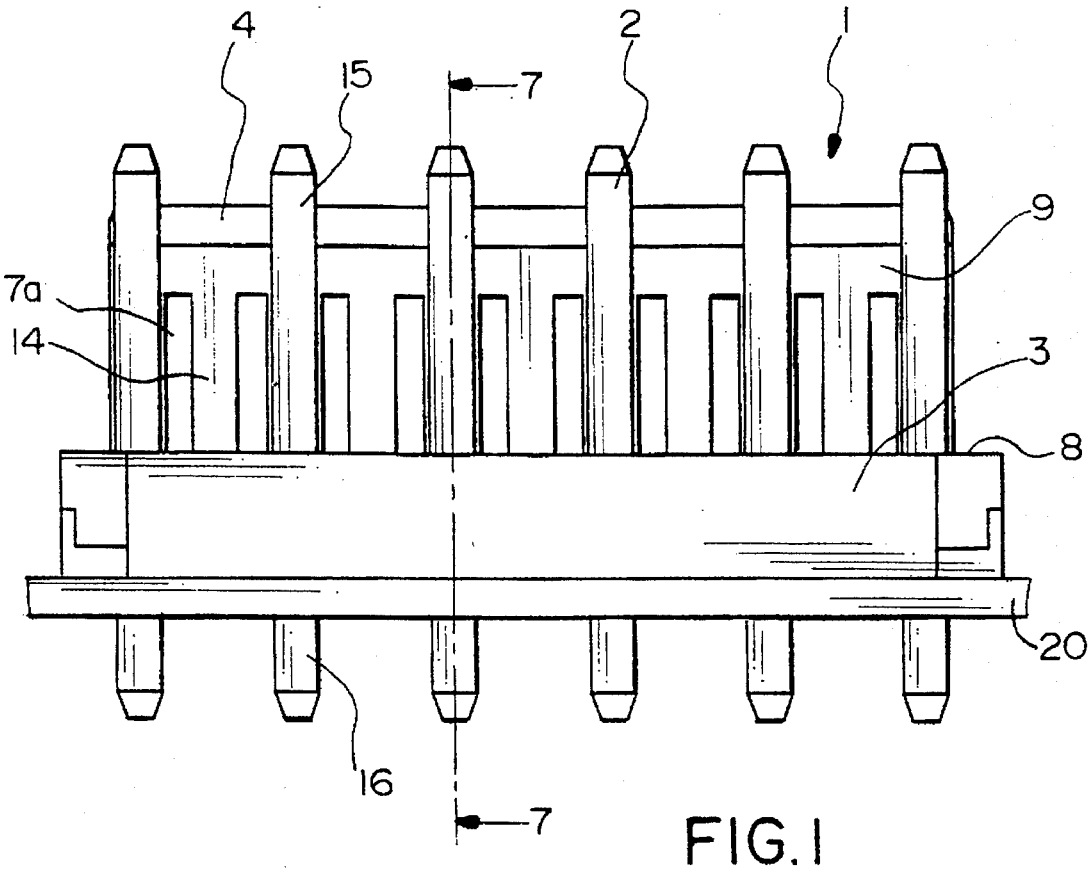
FIG. 1 is a front view of the header according to a first embodiment of the present invention.
Figure 2:
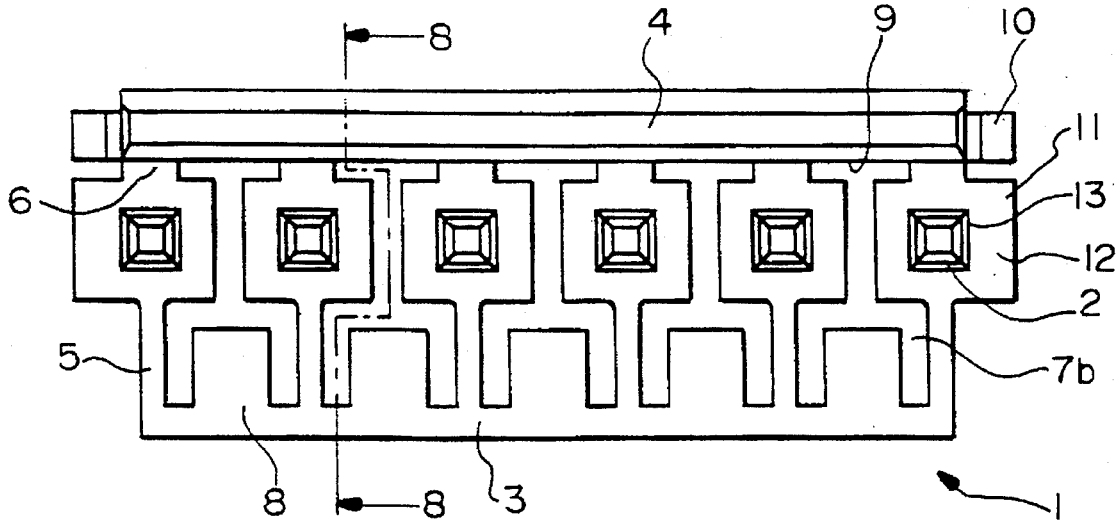
FIG. 2 is a top view of the header.
Figure 3:
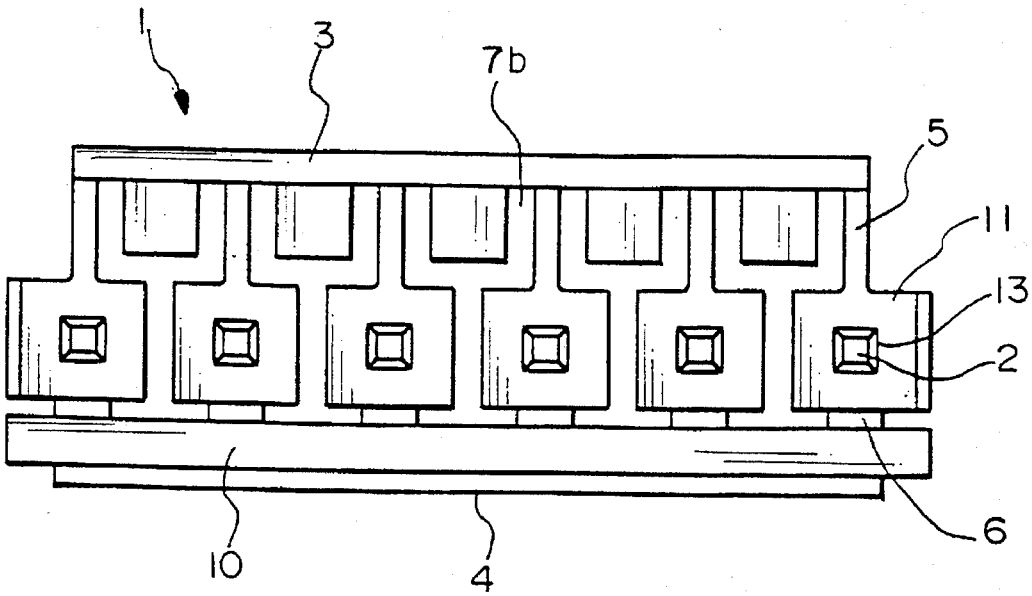
FIG. 3 is a bottom view of the header.
Figure 4:
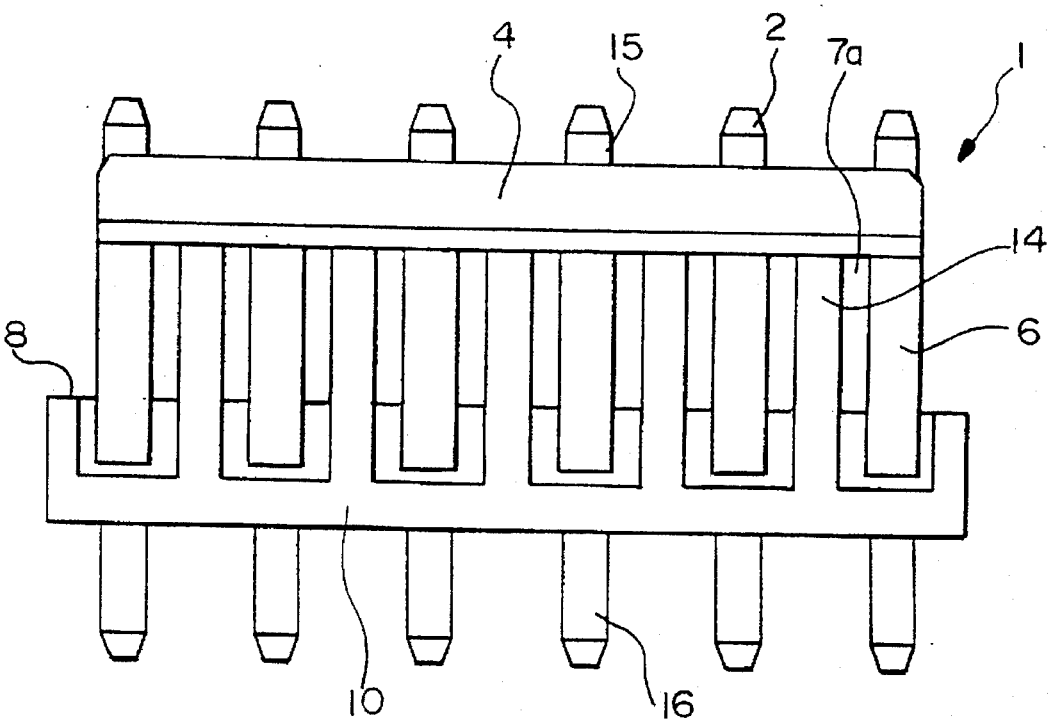
FIG. 4 is a rear view of the header.
Figure 5:
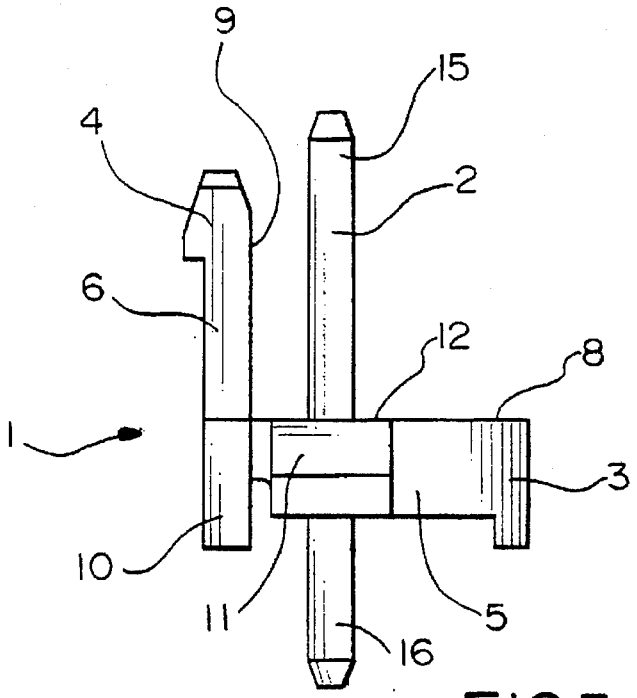
FIG. 5 is a left side view of the header.
Figure 6:
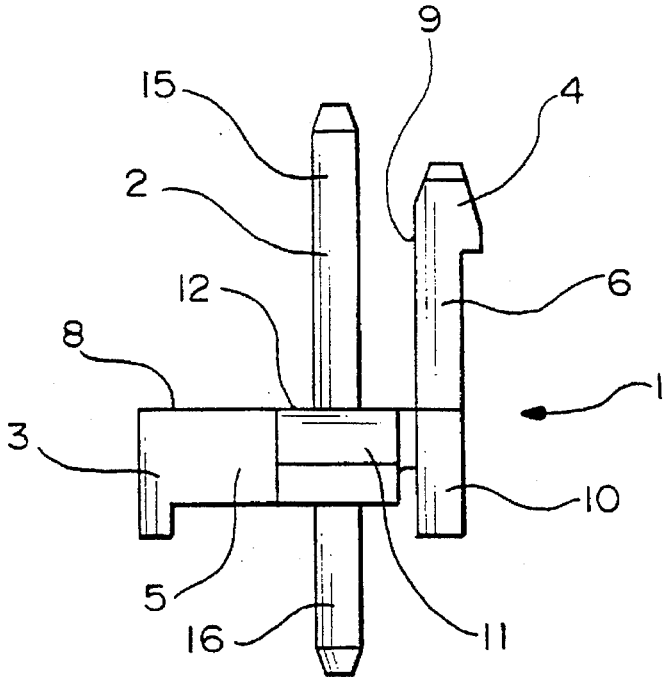
FIG. 6 is a right side view of the header.
Figure 7:
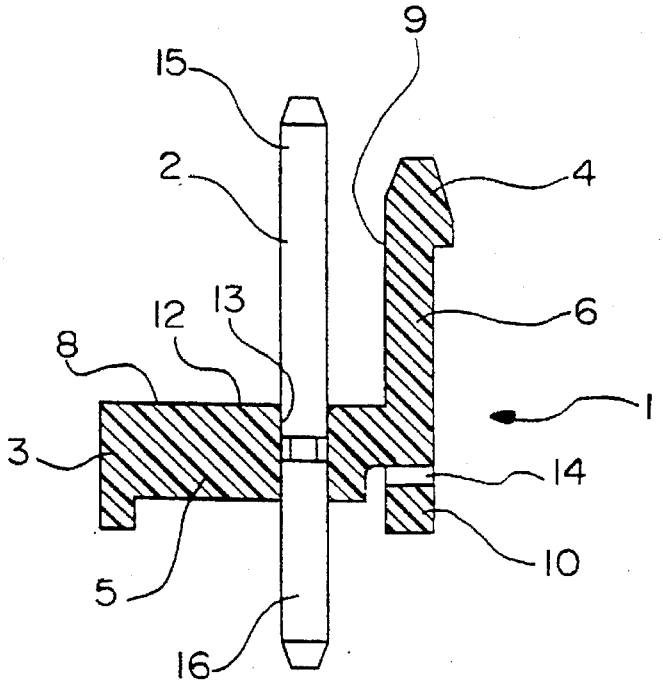
FIG. 7 is a sectional view of the header taken along the line 7—7 in FIG. 1.
Figure 8:
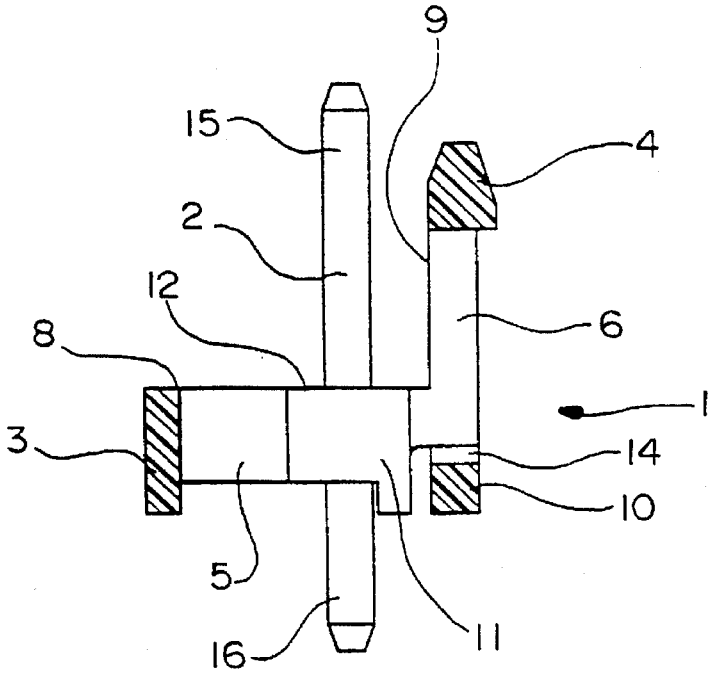
FIG. 8 is a sectional view of the header taken along the line 8—8 in FIG. 2.
Figure 9:
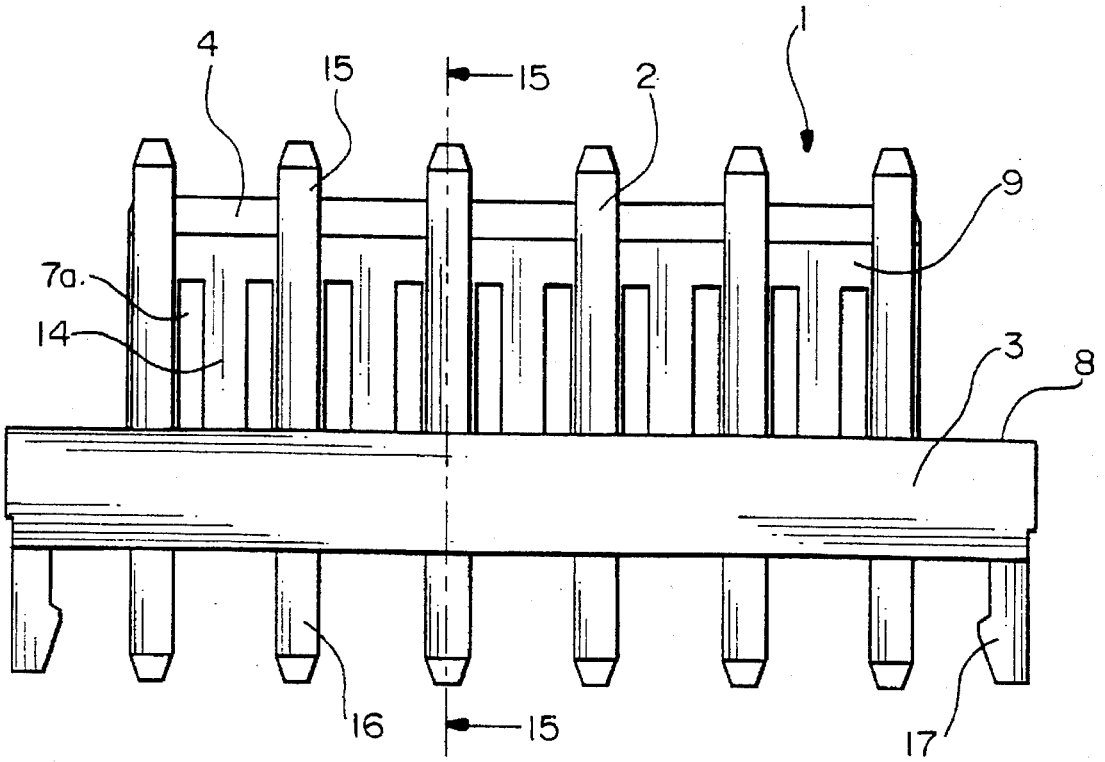
FIG. 9 is a front view of the header according to a second embodiment of the present invention.
Figure 10:
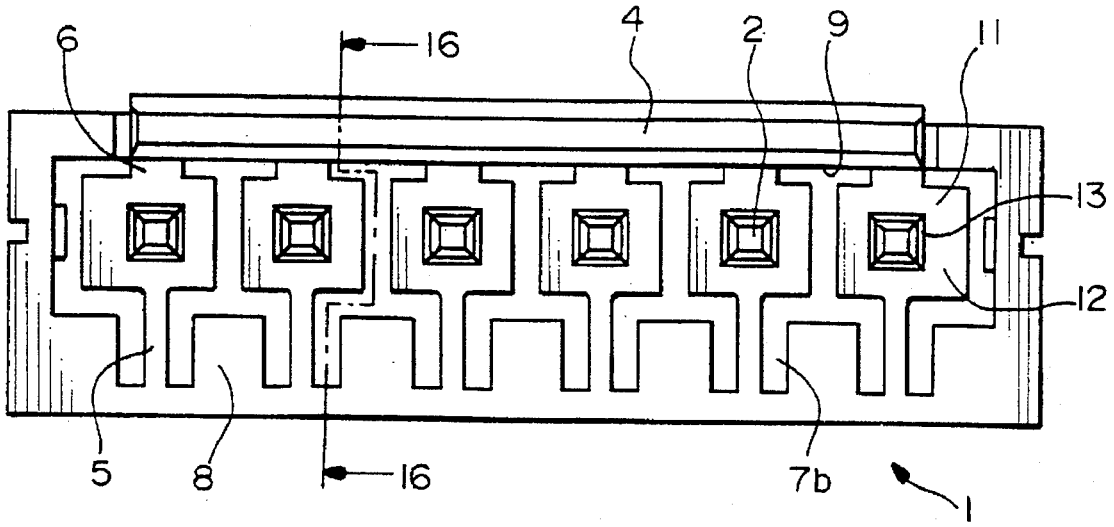
FIG. 10 is a top view of the header.
Figure 11:
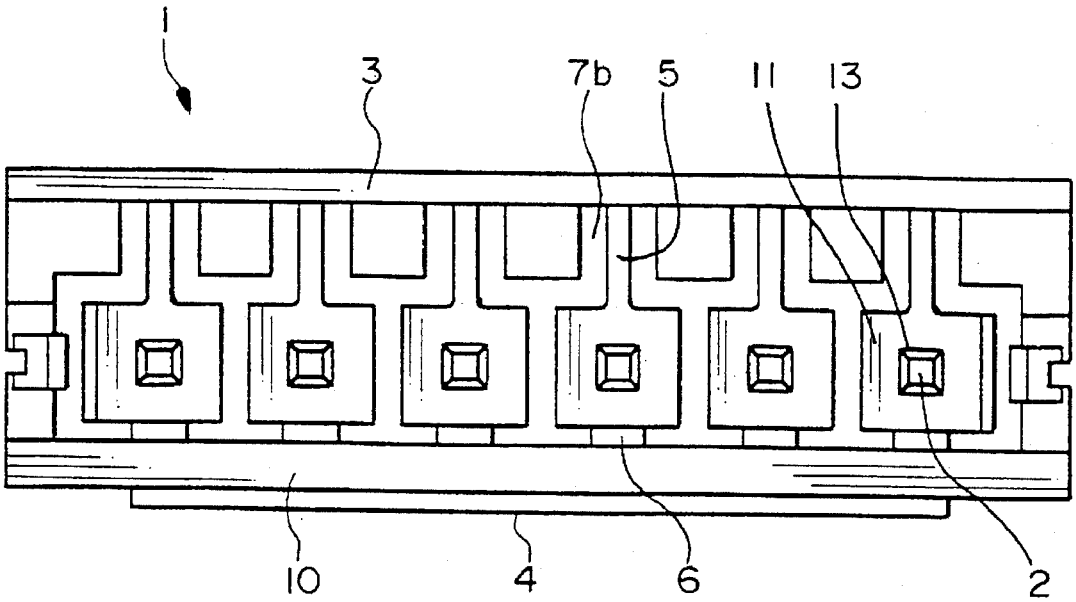
FIG. 11 is a bottom view of the header.
Figure 12:
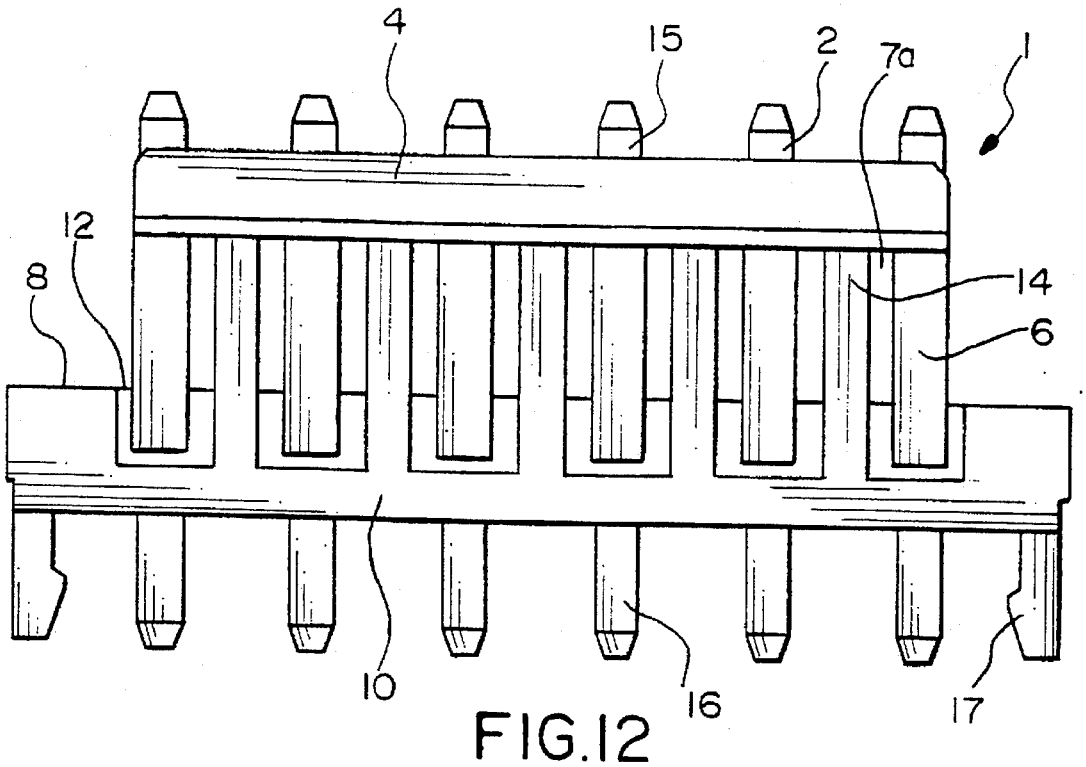
FIG. 12 is a rear view of the header.
Figure 13:
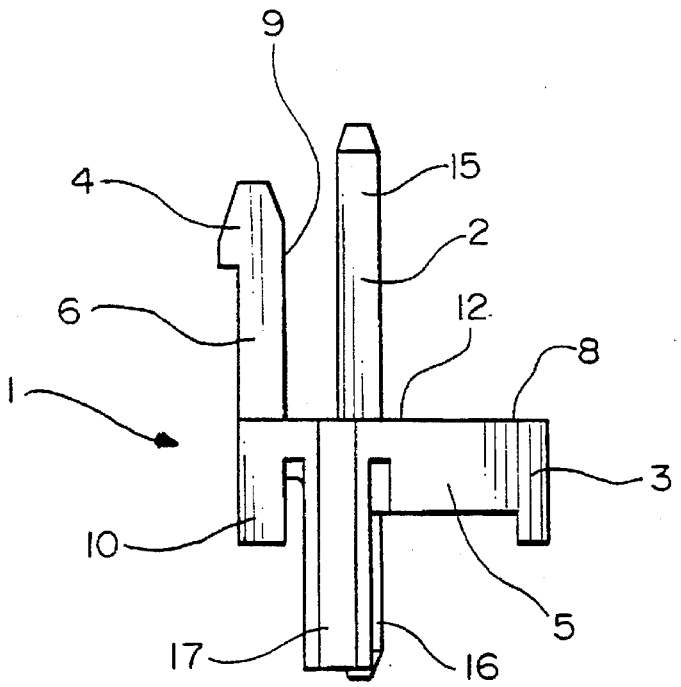
FIG. 13 is a left side view of the header.
Figure 14:
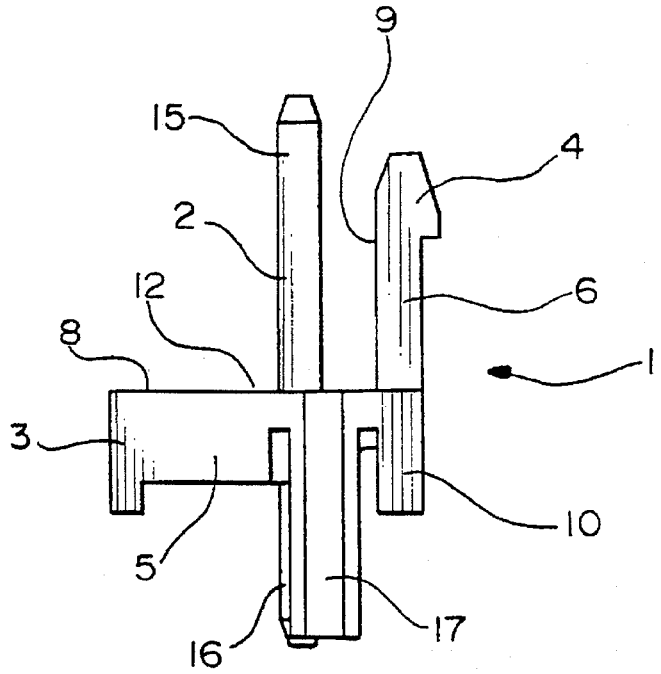
FIG. 14 is a right side view of the header.
Figure 15:
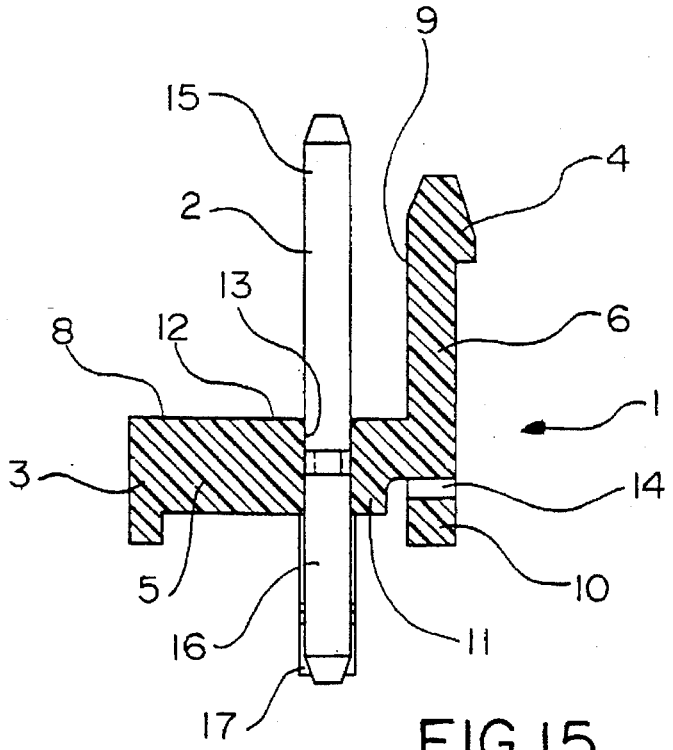
FIG. 15 is a sectional view of the header taken along the line 15—15 in FIG. 9.
Figure 16:
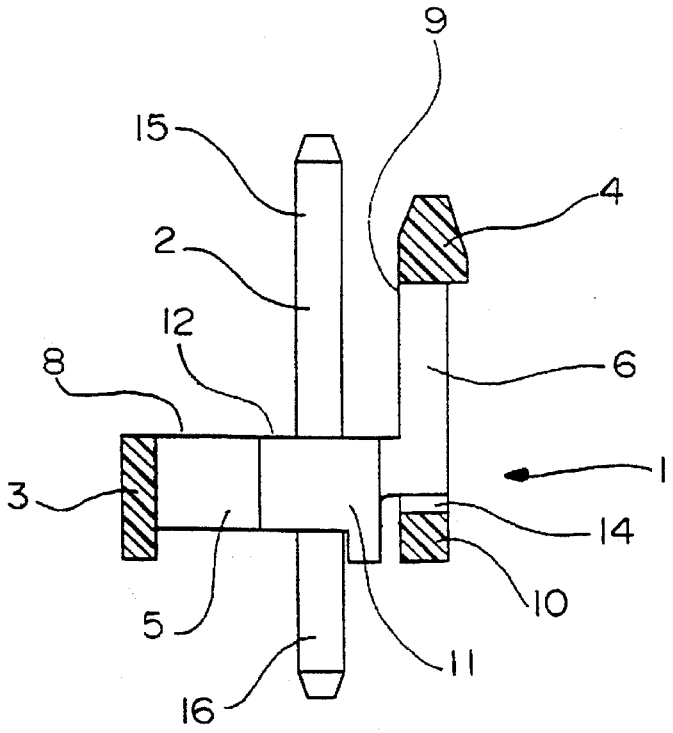
FIG. 16 is a sectional view of the header taken along the line 16—16 in FIG. 10.
Figure 17:
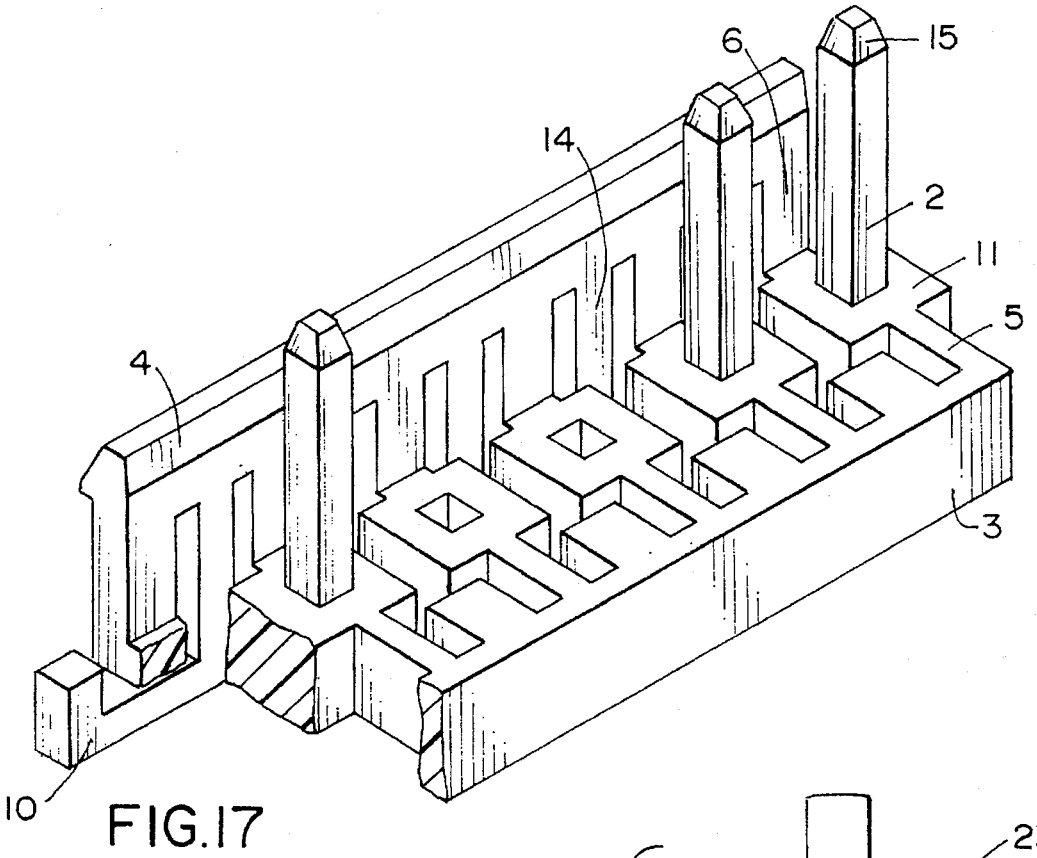
FIG. 17 is an isometric view of the header of the first embodiment.

FIGS. 1–8 and 17 show an header according to the first embodiment of the present invention as having a plurality of pin terminals 2 press fit in the corresponding plurality of terminal holding sleeves 11 made in a dielectric housing 1, as described later. The housing 1 has an "L"-shaped body which is composed of a vertical wall and a horizontal floor.

The vertical wall comprises a first longitudinal support beam 4 which is generally rigid and a lateral arrangement of first flexible joints 6. These first flexible joints 6 are separated by first slits 7*a* and are integrally connected to the first longitudinal support beam 4. The horizontal floor comprises a second longitudinal support beam 3 which is generally rigid, a lateral arrangement of second flexible joints 5 and a lateral arrangement of second slits 7*b* separating the second flexible joints 5, and are integrally connected to the second longitudinal support beam 3. Each of the terminal holding sleeves 11 has a aperture through which the terminal pins are inserted in a press fit relationship. These terminal holding sleeves 11 are integrally connected both to the first flexible joints 6 of the vertical wall and the second flexible joints 5 of the horizontal floor. The vertical plane 9 defined by the vertical wall, rises at a right angle relative to the horizontal plane 8. The terminal holding sleeves 11 are part of the horizontal plane.

The selective movement of the terminal holding sleeves 11 is due to the design of the flexible joints 5 and 6. Each holding sleeve has a given width. The flexible joints 5 and 6 are designed to have a width less than the width of the holding sleeve. This allows easy movement of the holding sleeve in a plane parallel to the plane of the printed circuit board while resisting movement the holding sleeve in a direction perpendicular to the plane of the printed circuit board as well as resisting a twisting movement.

Figure 20:
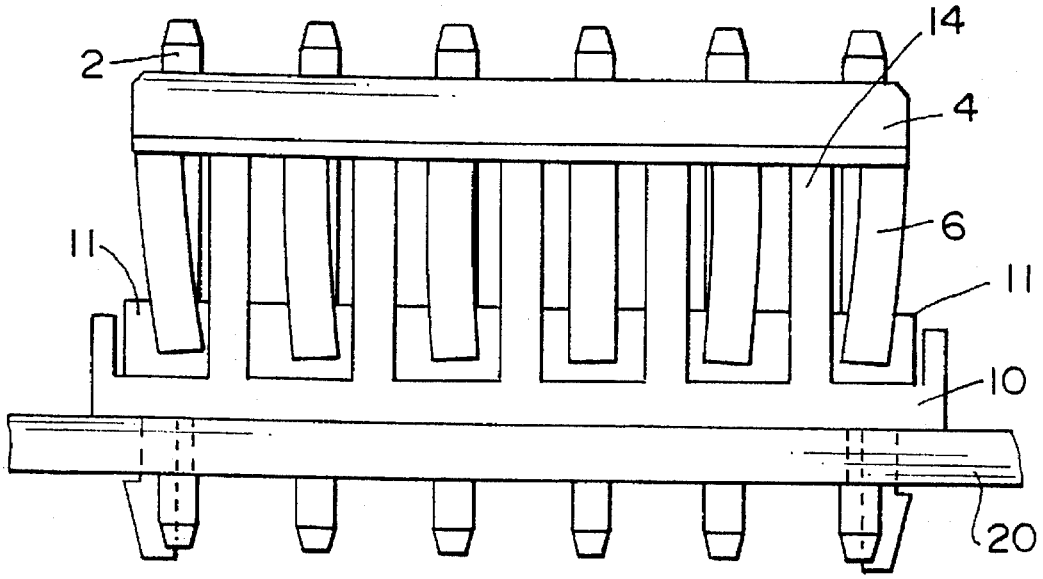
FIG. 20 is a side view of the header of the first embodiment showing the effect of thermal expansion of the printed circuit board and the header on the location of the terminal pins.

The vertical wall has a third auxiliary longitudinal support beam 10 which is generally rigid and is integrally connected to the bottom of the lateral arrangement of first joints 6. The third longitudinal support beam 10 is also integrally connected to the first longitudinal support beam 4 byway of a plurality of intervening third flexible joints 14 extending therebetween adjacent first flexible joints 6. With this arrangement, as shown in FIG. 20, the terminal holding sleeves 11 can move not only independent from each other but also they move independent from the longitudinal support beams 3, 4 and 10.

Each pin terminal 2 has a contact portion 15 at one end thereof and a tail portion 16 at the other end thereof. The tail portion 16 is to be soldered to a selected conductor on a printed circuit board. In use, the header is placed in a selected position on a printed circuit board 20 with the tail portions 16 of the pin terminals 2 inserted in the mounting holes (not shown) of the printed circuit board. Next the tail portions 16 of the pin-terminals 2 are soldered to selected conductors of the printed circuit. During the soldering procedure stress could occur between the pin-terminals 2 and the conductors on the printed circuit board due to the difference between the thermal expansion of the housing holding the terminals and the printed circuit board.

Figure 18:
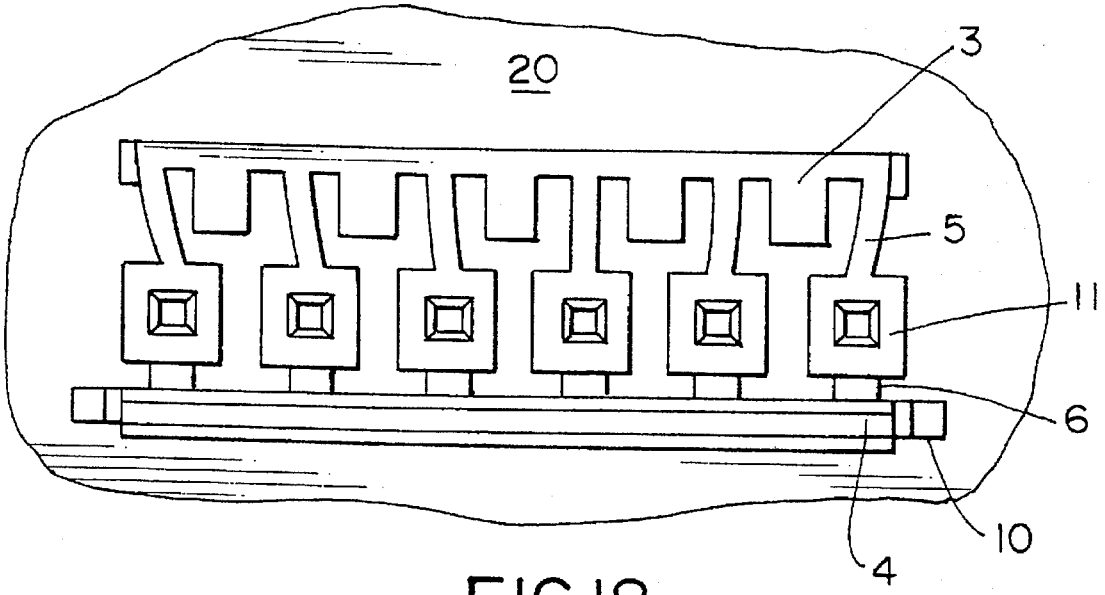
FIG. 18 is a top view of the header of the first embodiment showing the effect of thermal expansion of the printed circuit board and the header on the location of the terminal pins.

This invention absorbs this stress by allowing the displacement of the terminal holding sleeves 11 and thus the terminal pins independent from the housing. The absorption of the stress due to this displacement is shown in FIGS. 18 and 20. The terminal holding sleeves 11 are connected to the first and second longitudinal support beams 4 and 3 via the first and second flexible joints 6 and 5. These flexible joints 4 and 3 are separated from each other by the intervening slits 7*a* and 7*b* so that each terminal holding sleeve 11 may be displaced without any interference or influence on adjacent terminal holding sleeves. Because the stress is absorbed, the soldered spots will not peel off or crack.

The "L"-shaped structure of the electric connector has the additional effect of increasing the resistance of the housing against twisting. This will further improve the stability of the electric connector relative to the printed circuit board while still permitting a relatively large displacement of terminal holding sleeves 11 to absorb any stress caused between pin-terminals and selected conductors on the printed circuit board.

The third longitudinal auxiliary support beam 10, which is integrally connected to the first longitudinal support beam 4 via the third flexible joints 14, has the effect of increasing the bending resistance of the vertical plane 9, and, at the same time, increasing the twisting resistance of the housing 1. Accordingly, this resistance to vertical and twisting movement will improve the stability of the header relative to the printed circuit board.

The intervening slits 7*b* between adjacent terminal holding sleeves 11 and between adjacent second flexible joints 5 may have a film flexible enough to cause no adverse effect on the independent displacement of each of the adjacent terminal holding sleeves. Such flexible film can prevent flux material from entering the slits 7*b* and attaching to the contact portions 15 of the pin terminals 2 during the soldering procedure.

Figure 19:
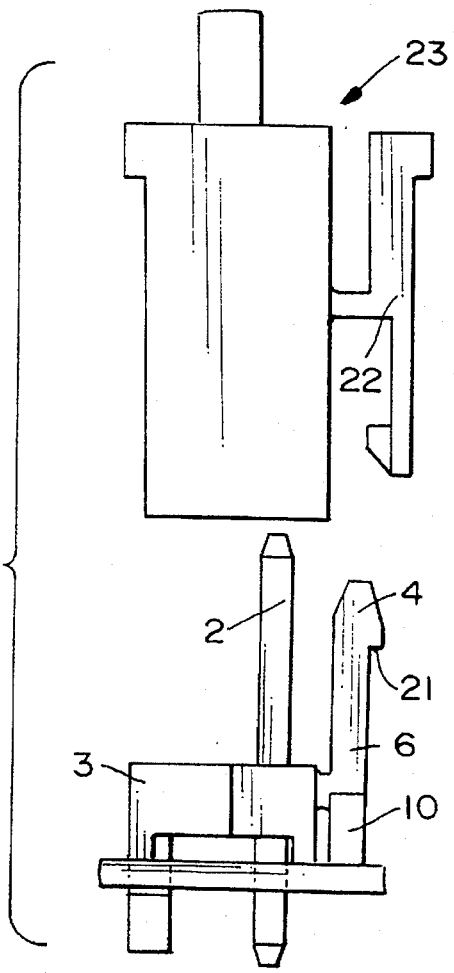
FIG. 19 is a side view of the header on a printed circuit board with a mating connector.

With the first longitudinal support beam 4 located in a position away from the printed circuit board, it can be used to engage locking means on a mating connector as shown in FIG. 19. First longitudinal support beam 4 forms a shoulder 21 which is engaged by a locking member 22 from a mating connector 23.

FIGS. 9–16 show a header according to the second embodiment of the present invention. The housing 1 of the electric connector has pegs 17 fixed to its opposite ends, thereby facilitating the positioning of the header to a printed circuit board prior to soldering and at the same time, improving the stability with which the connector can be fixed to the printed circuit board.

In this particular embodiment the third longitudinal auxiliary support beam 10 is directly connected to the second longitudinal support beam 3, and indirectly connected to the first longitudinal support beam 4 through the terminal holding sleeves 11.

While this invention is described in connection with a preferred embodiment, it will be understood that this invention is not intended to be limited to that one embodiment. On the contrary, this invention is intended to cover all alternatives, modifications and equivalents within the spirit and scope of the invention as defined by the appended claims.

We claim:

1. A header mounted to a surface of a printed circuit board, the header having a plurality of terminal pins adapted to be soldered to holes in the printed circuit board comprising:

the plurality of terminal pins in a parallel side by side array; and a housing made of a dielectric material and having, a holding sleeve for each one of the plurality of terminal pins, first and second generally rigid longitudinal support beams parallel to each other and located on opposite sides of the side by side pin array, and first and second flexible joints extending from each holding sleeve, the first flexible joint joining the holding sleeve to the first longitudinal support beam and the second flexible joint joining the holding sleeve to the second longitudinal support beam, the flexible joints adapted to allow movement of each holding sleeve independent from one another in a plane parallel to the plane of the printed circuit board so that the terminal pins can move independently toward and away from each other wherein each holding sleeve has a given width and at least one of the first and second flexible joints from each holding sleeve has a width less than the width of the holding sleeve from which it extends.

2. A header according to claim 1 wherein the second longitudinal support beam is located in close proximity to the surface of the printed circuit board and the first longitudinal support beam is located a short distance from the surface of the printed circuit board.

3. A header according to claim 2 wherein the first longitudinal support beam is adapted to engage with and lock onto a locking member on a connector mateable with the terminal pins.

4. A header according to claim 3 wherein the housing has a an "L" shaped cross section.

5. A header according to claim 1 wherein each terminal pin is press fit into a respective holding sleeve.

6. A header mounted to a surface of a printed circuit board, the header having a plurality of terminal pins adapted to be soldered to holes in the printed circuit board comprising:

the plurality of terminal pins in a parallel side by side array; and a housing made of a dielectric material and having, a holding sleeve for each one of the plurality of terminal pins, first and second generally rigid longitudinal support beams parallel to each other and located on opposite sides of the side by side pin array, first and second flexible joints extending from each holding sleeve, the first flexible joint joining the holding sleeve to the first longitudinal support beam and the second flexible joint joining the holding sleeve to the second longitudinal support beam, the flexible joints adapted to allow movement of each holding sleeve independent from one another in a plane parallel to the plane of the printed circuit board so that the terminal pins can move independently toward and away from each other, wherein the second longitudinal support beam is located in close proximity to the surface of the printed circuit board and the first longitudinal support beam is located a short distance from the surface of the printed circuit board, and wherein a third generally rigid longitudinal support beam is provided, the third longitudinal support beam, parallel to the first and second support beams, being located in close proximity to the mounting surface of the printed circuit board on the side of the pin array that the first longitudinal support beam is located, a plurality of third flexible joints extending from and connecting the first and third longitudinal support beams, each of the third flexible joints located between adjacent first flexible joints extending between the first longitudinal support beam and the holding sleeves.

* * * * *